United States Patent [19]

Hengesbach

[11] Patent Number: 4,515,310

[45] Date of Patent: May 7, 1985

[54] SPRAYING APPARATUS AND METHOD

[76] Inventor: Robert W. Hengesbach, 27331 Tungsten Rd., Euclid, Ohio 44132

[21] Appl. No.: 499,821

[22] Filed: Jun. 1, 1983

Related U.S. Application Data

[63] Continuation-in-part of Ser. No. 313,456, Oct. 21, 1981, abandoned.

[51] Int. Cl.[3] ..... B05B 7/30

[52] U.S. Cl. ..... 239/8; 239/366; 239/368

[58] Field of Search ..... 239/341, 342, 344, 346, 239/354, 364, 368, 8, 366

[56] References Cited

U.S. PATENT DOCUMENTS

| | | | |
|---|---|---|---|
| Re. 21,391 | 3/1940 | Holden . | |
| 1,145,029 | 7/1915 | Munro | 239/368 X |
| 1,476,810 | 12/1923 | Gilsenan . | |
| 1,988,979 | 1/1935 | Campbell . | |
| 2,072,555 | 3/1937 | Hengesbach et al. . | |
| 2,125,573 | 8/1938 | Kelley, Jr. | 239/354 X |
| 2,302,799 | 11/1942 | Peterson | 239/344 X |
| 2,589,728 | 3/1952 | Pratt . | |
| 2,659,629 | 11/1953 | Graham . | |
| 2,671,626 | 3/1954 | Schmadeke . | |
| 2,938,534 | 5/1960 | Bos . | |
| 3,131,834 | 5/1964 | Meshberg . | |
| 3,181,737 | 5/1965 | Chaucer . | |
| 3,388,838 | 6/1968 | Marchant . | |
| 3,632,046 | 1/1972 | Hengesbach . | |
| 3,675,275 | 7/1972 | Arblaster . | |
| 3,756,273 | 9/1973 | Hengesbach . | |

*Primary Examiner*—Andres Kashnikow
*Attorney, Agent, or Firm*—David A. Burge

[57] ABSTRACT

An improved spraying apparatus utilizes a novel method of withdrawing sprayable liquid from a pressurized vessel at a controlled rate, whereby the discharge rate of the spraying apparatus may be preset or selectively controlled within a desired range. Control of the rate at which liquid discharges from the apparatus is effected by pre-setting or regulating the effective size of one or more gas entry openings provided in a liquid withdrawal conduit which depends into the pressure vessel. The gas entry openings communicate with an upper end region of the vessel wherein a quantity of pressurized carrier gas is maintained. In one embodiment, all carrier gas must flow through the vessel before being discharged by the apparatus. In another embodiment, a restricted flow of carrier gas is combined with a mixture of gas and liquid issuing from the pressure vessel for generating a highly atomized, fog-like spray.

25 Claims, 15 Drawing Figures

SPRAYING APPARATUS AND METHOD

CROSS-REFERENCE TO RELATED APPLICATION

The present application is a continuation-in-part of a co-pending but now abandoned application Ser. No. 313,456, entitled SPRAYING APPARATUS AND METHOD OF CONTROLLING RATE OF DISCHARGE OF MATERIALS THEREFROM, filed Oct. 21, 1981 by Robert W. Hengesbach, hereinafter referred to as the "Spraying Apparatus Case," the disclosure of which is incorporated herein by reference.

BACKGROUND OF THE INVENTION

1. Field of the Invention

The present invention relates to an improved spraying apparatus and method which enable the rate of flow of liquid being withdrawn from a pressurized vessel for spraying to be preset or variably controlled without detrimentally influencing the capability of the spraying apparatus to reliably provide a desired spraying action and to a spraying system which, with relatively minor modifications in apparatus, will provide either a mist-type spray or a more highly atomized fog-type spray.

2. Prior Art

Many proposals have been made in efforts to provide reliable apparatus for spraying various types of liquids from vessels in various ambient conditions. Problems common to many proposed spraying systems are their inabilities to accommodate fluids of a wide range of viscosities, and to provide the desired spraying actions with fluids in environments of differing air pressure, temperature and humidity.

While spray regulating devices of various types have been proposed in efforts to render spraying systems adjustable for use with changes in liquid properties, and to accommodate various ambient conditions, such proposals have typically failed to provide as wide a range of adjustment as desired. In many instances the incorporation of such proposals into spraying systems have detrimentally affected spraying system operation by increasing the propensity of the system to clog.

Still another drawback encountered with many previous spraying system proposals lies in the inabilities of the proposed systems to be preset, within a wide range of adjustability, to provide a desired fixed rate of discharge of spray material.

Prior proposals for spraying apparatus have provided very differently configured products for use where mist-type sprays were desired as opposed to more highly atomized fog-type sprays. Prior proposals have not provided a desirably simple type of modification for selectively structuring a spraying apparatus to selectively provide mist or fog-type sprays.

SUMMARY OF THE INVENTION

The present invention overcomes the foregoing and other drawbacks of prior proposals by providing a spraying system which enables the rate of discharge of spray material to be preset or variably controlled throughout a wide range, and by providing a spraying apparatus can be easily modified to provide either a mist-type spray or a more highly atomized fog-type spray.

A spraying apparatus embodying the preferred practice of the present invention provides means of for controlling the rate of discharge of material being sprayed by presetting or regulating the effective size of one or more gas entry openings located in a liquid withdrawal conduit which depends into a pressurized vessel which contains a liquid to be sprayed. In one embodiment, the flow rate of a spraying apparatus is preset by providing one or more non-adjustable gas entry openings of predetermined size. In other embodiments, means are provided for adjustably presetting or regulating the effective size of one or more gas entry openings that admit a proportioned flow of carrier gas from an upper region of the pressurized vessel to a flow of liquid which is being forced from the vessel under the influence of pressure.

In accordance with one of the embodiments of the present invention, a spraying apparatus is configured such that all entering carrier gas is caused to pass through the pressure vessel, whereby a mist-type spray is caused to discharge from the apparatus. In accordance with an alternate embodiment, a restricted flow of carrier gas is permitted to pass directly from an inlet conduit to an outlet conduit for effecting a turbulent atomization of the mixture of gas and liquid which is being withdrawn from the pressure vessel, whereby a highly atomized fog-type spray is caused to discharge from the apparatus. The difference between these two embodiments is a simple matter of the provisions or exclusion of a restricted flow passage provided between inlet and outlet conduits of the apparatus. In preferred practice, the inlet and outlet conduits are arranged in axial alignment, and the restricted passage can be provided by drilling a small hole to communicate the two conduits.

BRIEF DESCRIPTION OF THE DRAWINGS

These and other features and a fuller understanding of the invention will be had by referring to the following description and claims taken in conjunction with the accompanying drawings, wherein:

DESCRIPTION OF THE PREFERRED EMBODIMENT

Figure 1:
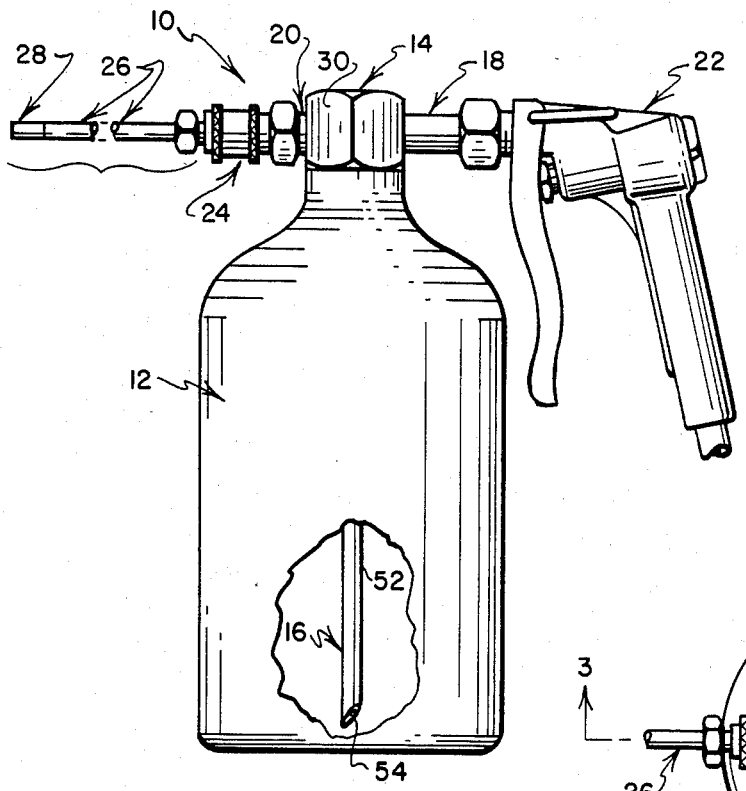
FIG. 1 is side elevational view of a first embodiment of a spraying apparatus incorporating features of the present invention, with portions of a vessel thereof broken away, and with a discharge wand foreshortened.
Figure 2:
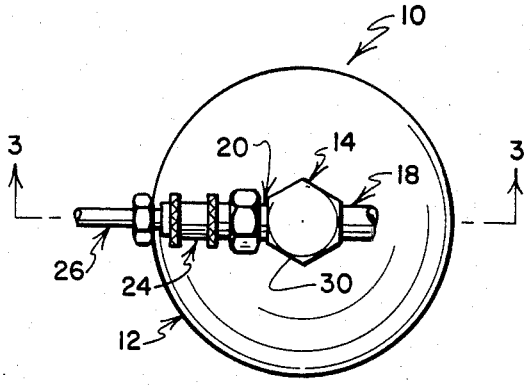
FIG. 2 is a top plan view of portions of the apparatus of FIG. 1.
Figure 3:
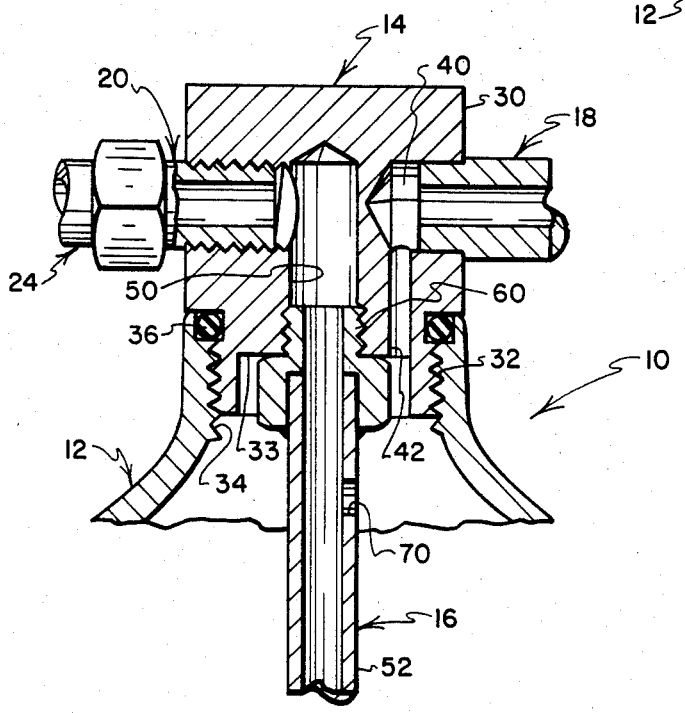
FIG. 3 is a sectional view, on an enlarged scale, of portions of the apparatus of FIG. 1, as seen from a plane indicated by a line 3—3 in FIG. 2.
Figure 4:
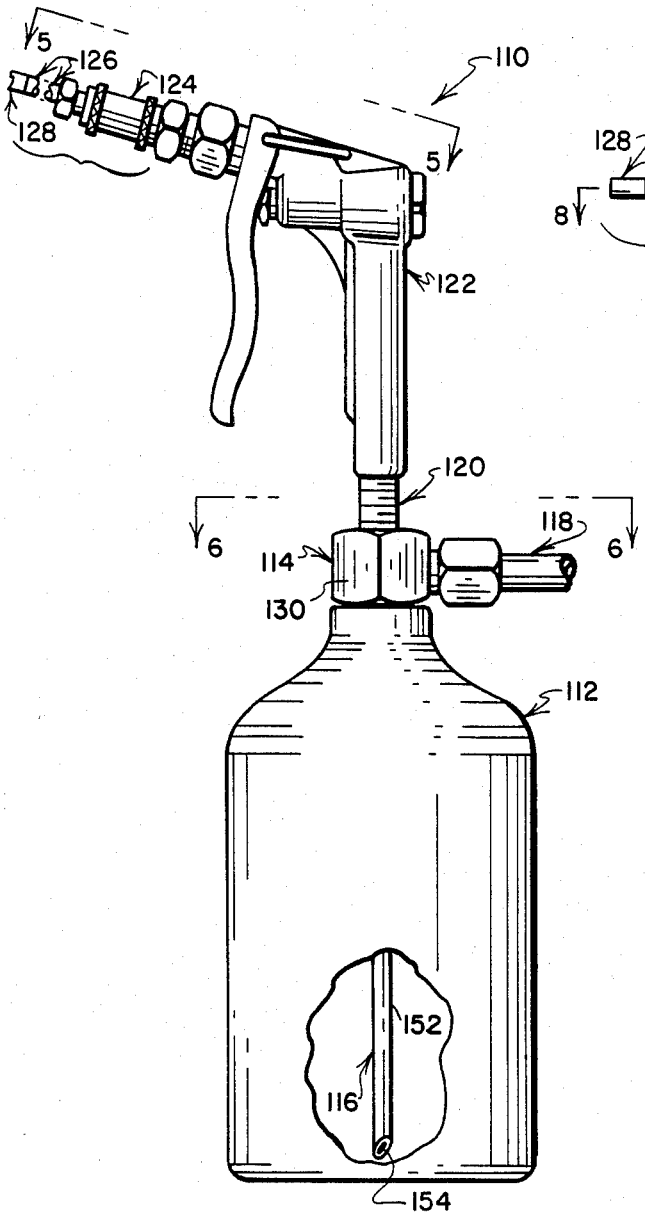
FIG. 4 is a side elevational view of a second embodiment of spraying apparatus incorporating features of the present invention, with portions of a vessel thereof broken away, and with a discharge wand foreshortened.
Figure 5:
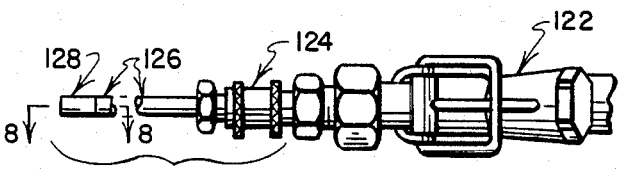
FIG. 5 is a view of portions of the apparatus as seen from a plane indicated by a line 5—5 in FIG. 4.
Figure 6:
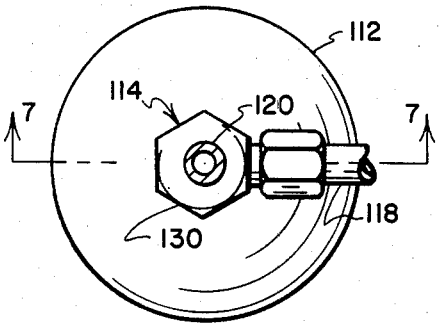
FIG. 6 is a sectional view as seen from a plane indicated by a line 6—6 in FIG. 4.

Features of the present invention can be utilized in conjunction with a variety of known, conventional spray apparatus components to provide a spraying system, the output from which is either preset or controllable to provide a desired rate of discharge of spray solution. FIGS. 1–3 illustrate features of the invention employed in a spray apparatus 10 of the type having a trigger-operated valve assembly 22 which is located upstream from a spray solution reservoir vessel 12. FIGS. 4–7 illustrate features of the invention employed in a spray apparatus 110 of the type having a trigger-operated valve assembly 122 which is located downstream from a spray solution reservoir vessel 112. The trigger-operated valve assemblies 22, 122 are preferably of the general types described in U.S. Pat. Nos. 3,756,273, 3,632,046 and 2,072,555, the disclosures of which are incorporated herein by reference.

By locating the control valve 22 upstream from the vessel 12, as is exemplified by the apparatus 10, the vessel 12 is caused to be pressurized by a supply of gas only when the valve 22 is operated to effect spraying. An advantage of this type of arrangement is that the vessel 12 is maintained at ambient pressure when spraying is not in progress, whereby the vessel 12 can be opened for refilling without concern that its contents are pressurized. By locating the control valve 122 downstream from the vessel 112, as is exemplified by the apparatus 110, the vessel 112 is normally maintained in a pressurized mode. An advantage of this type of arrangement is that an immediate "instant on, instant off" spraying control is provided by the valve 122.

Referring to FIGS. 1–3, the spray apparatus 10 includes a plug assembly 14 which is secured atop the upstanding pressure vessel 12. A suction tube assembly 16 depends from the plug assembly 14 into the vessel 12 for ducting solution from vessel 12 during spraying. An inlet conduit 18 and an outlet conduit 20 communicate with the plug assembly 14 in a manner which will be described. The control valve assembly 22 communicates the inlet conduit 18 with a source of pressurized gas (not shown) for selectively admitting pressurized gas to the vessel 12. A conventional quick-disconnect coupler 24 connects one end of an elongate discharge tube or wand 26 with the outlet conduit 20. A discharge nozzle 28 is provided on the tip end of the discharge wand 26 for discharging a mixture of gas and solution from the vessel 12 in a controlled spray pattern.

Referring to FIGS. 4–7, the spray apparatus 110 includes a plug assembly 114 which is secured atop the upstanding pressure vessel 112. A suction tube assembly 116 depends from the plug assembly 114 into the vessel 112 for ducting solution from the vessel 112 during spraying. An inlet conduit 118 and an outlet conduit 120 communicate with the plug assembly 114 in a manner which will be described. The inlet conduit 118 is connectable to a source of pressurized gas (not shown) for admitting pressurized gas to the vessel 112. The control valve assembly 122 selectively communicates the outlet conduit 120 with a conventional quick-disconnect coupler 124. One end of an elongate discharge tube or wand 126 connects with the coupler 124. A discharge nozzle 128 is provided on the tip end of the discharge wand 126 for discharging a mixture of gas and solution from the vessel 112 in a controlled spray pattern.

Figure 7:
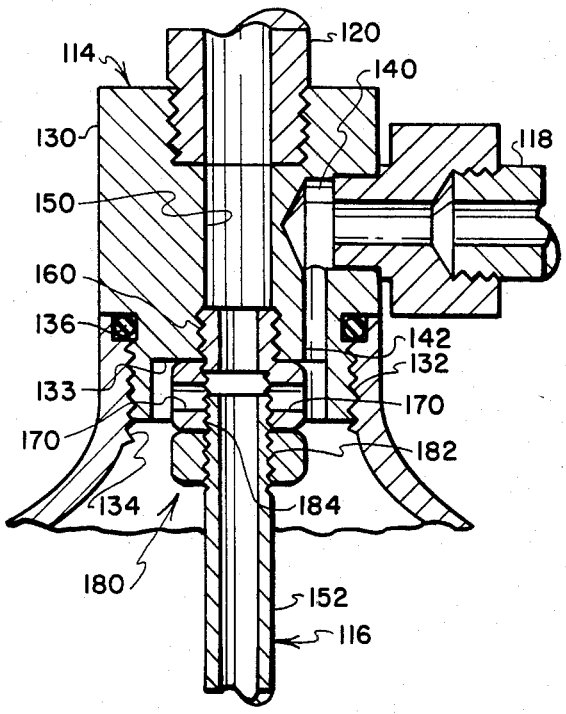
FIG. 7 is a sectional view, on an enlarged scale, of portions of the apparatus of FIG. 4 as seen from a plane indicated by a line 7—7 in FIG. 6.

Referring to FIGS. 3 and 7, the plug assemblies 14, 114 are quite similar in configuration. Hex-shaped heads 30, 130 are located atop threaded base portions 32, 132. The threaded base portions 32, 132 are configured to be received within threaded neck portions 34, 134 of the vessels 12, 112. The base portions 32, 132 and the neck portions 34, 134 are configured to receive O-rings 36, 136 therebetween to establish fluid-tight seals between the plug assemblies 14, 114 and their associated vessels 12, 112.

The plug assemblies 14, 114 have inlet passages 40, 140 which communicate with the inlet conduits 18, 118 and which define inlet openings 42, 142 where the passages 40, 140 open through bottom walls 33, 133 of the base portions 32, 132 into communication with the upper end regions of the vessels 12, 112.

The plug assemblies 14, 114 have outlet passages 50, 150 which communicate with the outlet conduits 20, 120 with the suction tube assemblies 16, 116. The outlet passage 50 of the apparatus 10 extends upwardly and then horizontally and leftwardly (as viewed in FIG. 3) for connection with the outlet conduit 20. The outlet passage 150 of the apparatus 110 extends vertically upwardly (as viewed in FIG. 6) for connection with the outlet conduit 120.

The suction tube assemblies 16, 116 are similar in function but differ in construction. The assemblies 16, 116 include elongate tubes 52, 152 with connectors 60, 160 at their upper ends and with tapered liquid inlet openings 54, 154 formed at their lower ends. The connectors 60, 160 thread, respectively, into the outlet passages 50. 150. Gas entry openings 70, 170 are provided near the upper ends of the tube assemblies 16, 116. The assemblies 16, 116 differ in that, while the tube 16 is provided with a single gas entry opening 70 of fixed size, the tube 116 is provided with a pair of gas entry openings 170, and with an adjustment mechanism 180 for controlling the effective size of the openings 170, as will be described.

In operation, the plug assemblies 14, 114 are removed from the necks of the vessels 12, 112 to permit a sprayable liquid to be poured into the vessels. The plug assemblies 14, 114 are then replaced atop the vessels 12, 112 and sources of pressurized gas (not shown) are connected to the apparati 10, 110 to enable spraying to begin.

While the vessel 12 remains unpressurized until the valve assembly 22 is operated, the vessel 112 is immediately pressurized when connected to a source of pressurized gas. When the valve assemblies 22, 122 are operated, pressure within the vessels 12, 112 operates to force liquid into the tube assemblies 16, 116 through the liquid entry openings 54, 154. Liquid is also drawn into the tube assemblies 16, 116 through the openings 54, 154 as the result of an aspiration effect which is established as pressurized gas flows rapidly through the gas entry openings 70, 170 and into the outlet passages 50, 150.

A feature of the present invention is the provision of a simple and effective means by which the rate of discharge of spray from the apparati 10, 110 can be preset or variably controlled. A fixed setting is obtained by utilizing a suction tube assembly having one or more gas entry openings of fixed size, e.g., by using the suction tube assembly 16 with one or more gas entry holes 70 of a predetermined, fixed size. A controllable setting of the discharge rate is obtained by using a suitable system for adjusting the effective size of one or more gas entry openings provided in a suction tube assembly, e.g., by using a sleeve (not shown) slidably mounted on the suction tube 52 to close off part of the opening 70, or by using the mechanism 180 to control the effective size of one or more of the gas entry openings 170.

Referring to FIG. 7, the adjustment mechanism 180 utilizes a threaded connection formed between the tube stem 152 and the connector 160, to control the effective sizes of the gas entry openings 170. The tube stem 152 has an upper end region 182 which is threaded into a threaded hole 184 formed in the connector 160. The gas entry holes 170 open through opposed wall portions of the threaded hole 184. Communication between the gas entry holes 170 and the threaded hole 184 is controlled by the extent to which the threaded stem end 182 extends into the threaded hole 184. If the stem end 182 does not extend across any parts of the gas entry openings 170, the "effective sizes" of the openings 170 are their actual sizes. As the threaded stem end 182 is threaded farther into the threaded hole 184, the "effective sizes" of the openings 170 are diminished because the stem end 182 obstructs the passage of gas through the openings 170 into the hole 184.

Making a determination of the proper size to drill the gas entry hole 70, or of the proper "effective sizes" of the gas entry holes 170, is best achieved by conducting a brief experiment with a sample of a liquid to be sprayed. Inasmuch as spraying performance is affected by a wide variety of parameters such as various properties of the liquid to be sprayed (e.g., viscosity and temperature, etc.), as well as various characteristics of the ambient environment (e.g., temperature and elevation of the spraying site, etc.), providing one or more gas entry openings of a particular size or effective size for one spraying installation will not necessarily achieve the identical spray discharge rate at another installation.

Exemplary experimental results which can be obtained easily to determine the proper size for drilling the hole 70 in the tube assembly 16 were obtained utilizing a 70 PSIG source of pressurized air to spray a quart of water from a spraying apparatus having the configuration of the apparatus 10. The following chart presents a correlation of the diameter in inches of the hole 70 with the resulting time required to empty a quart of water from the vessel 12:

| Diameter in Inches | Time in Seconds |
|---|---|
| (no hole) | 12 |
| 0.0625 | 18 |
| 0.0820 | 21 |
| 0.1065 | 24 |
| 0.1200 | 28 |
| 0.1406 | 37 |
| 0.1660 | 49 |
| 0.1850 | 100 |

Exemplary experimental results which can be obtained easily to determine the proper setting of the adjustment mechanism 180 to control the effective sizes of the gas entry openings 170 was obtained using an 80 PSIG source of air to spray a quart of water from an apparatus having the configuration of the apparatus 110. With the openings 170 fully covered (i.e., closed) by the stem end 182, a quart of water was emptied from the vessel 112 in about 10 seconds. With the openings 170 unrestricted (i.e., unobstructed) by the stem end 182, the time of discharge was extended to over 5 minutes. With the openings 170 half closed by the stem end 182, spraying time was reduced to about 90 seconds. As will be readily apparent to those skilled in the art, a similar experiment can easily be conducted with a sample of a fluid to be sprayed, with the experiment being conducted in the ambient conditions wherein the spraying is to take place, whereby data may be obtained which will permit the preparation of a table, or the drawing of a graph correlating spray rate with setting positions of the adjustment mechanism 180. Using such a table or graph, the required setting of the adjustment mechanism 180 to obtain a desired spray discharge rate can be determined quite easily.

Figure 8:
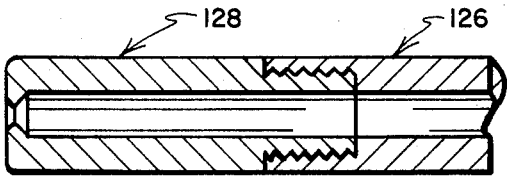
FIG. 8 is a sectional view, on an enlarged scale, of a tip end portion of a discharge wand, as seen from a plane indicated by a line 8—8 in FIG. 5.

An advantage of the system of the present invention is that it gives a reasonably well atomized flow of spray material which can be discharged through a relatively small diameter nozzle at the end of a relatively long, thin discharge wand. The use of a small diameter nozzle, such as is indicated by the numeral 128 in FIG. 8, together with a long, thin discharge wand 126, is particularly useful in vehicle rustproofing applications wherein it is desirable to spray inside surfaces of vehicle doors by inserting a small-diameter, nozzle-carrying wand through small holes formed inconspicuously in edge regions of the doors.

Figure 9:
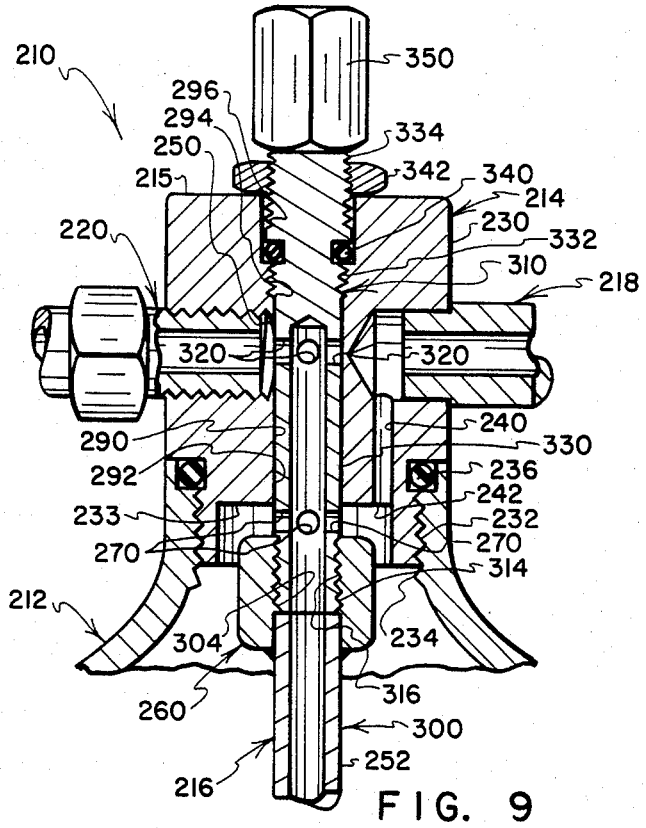
FIG. 9 is a sectional view similar to FIG. 3 of still another embodiment of spraying apparatus incorporating features of the present invention.

Referring to FIG. 9, still another embodiment of spray apparatus incorporating features of the present invention is shown, in part, as indicated generally by the numeral 210. The apparatus 210 includes a plug assembly 214 which is secured atop an upstanding pressure vessel 212. A suction tube assembly 216 has a lower part 300 which depends from the plug assembly 214 into the vessel 212 for ducting solution from the vessel 212 during spraying, and an upper part 310 which extends upwardly through a passage 290 formed through the plug assembly 214.

An inlet conduit 218 and an outlet conduit 220 communicate with the plug assembly 214. A trigger-operated valve assembly (not shown) of the type described in conjunction with the apparati 10, 110 connects with one or the other of the conduits 218, 220, as has been described in conjunction with the apparatus 10, 110, to provide a means for selectively initiating and terminating spraying.

In the manner of the previously described plug assemblies 14, 114, the plug assembly 214 has a hex-shaped outer surface 230 located atop a threaded base portion 232. The threaded base portion 232 is configured to be received within threaded neck portions 234 of the vessel 212. The base and neck portions 232, 234 are configured to receive an O-ring 236 therebetween to establish a fluid-tight seal between the plug assembly 214 and the vessel 212.

The plug assembly 214 has an inlet passage 240 which communicates with the inlet conduit 218, and which defines an inlet opening 242 where the passage 240 opens through a bottom wall 233 of the base portion 232. The plug assembly 214 has an outlet passage 250 which communicates the outlet conduit 220 with the central passage 290.

The central passage 290 has a smooth bore 292 which extends upwardly from the bottom wall 233 into communication with the outlet passage 250, a threaded bore 294 which extends upwardly a short distance from the outlet passage 250, and a larger-diameter smooth bore 296 which opens through a top wall 215 of the plug assembly 214.

The lower part 300 of the suction tube assembly 216 includes an elongate tube 252 which has a connector 260 welded to its upper end. The tube 252 extends downwardly into the vessel 212 and has a tapered lower end region (not shown) configured in the manner of the previously described tubes 52, 152 to define an inclined liquid-entry opening (not shown) located in a lower region of the vessel 212.

Figure 10:
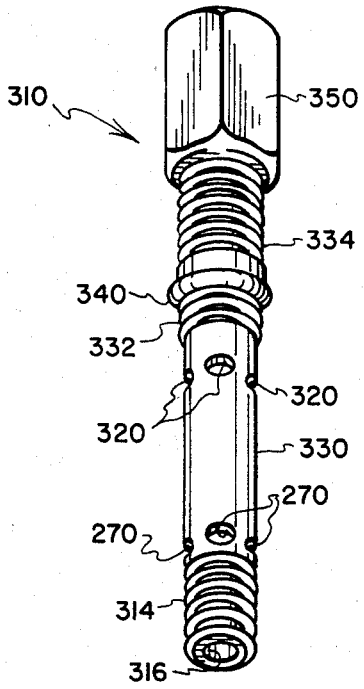
FIG. 10 is a perspective view, on an enlarged scale, of one component employed in the apparatus of FIG. 9.

The connector 260 carries internal threads 304 which receive a threaded lower end region 314 of the upper part 310. Referring to FIGS. 9 and 10, the upper part 310 has a passage 316 which extends upwardly for about half of the length of the upper part 310, and has lower and upper sets of radially extending holes 270, 320 which communicate with the passage 316. When the threaded lower end region 314 is threaded to the fullest extent possible into the threaded portion 304 of the connector 260, the lower set of holes 270 assumes a position immediately above the upper surface of the connector 260. At least the lower portions of each of the holes 270 are located below the bottom wall 233. As will be explained, the "effective sizes" of the holes 270 are controlled by adjustably positioning the suction tube assembly 216 to control the degree to which the holes 270 extend below the bottom wall 233.

The upper part 310 has a smooth cylindrical, outer surface portion 330 which slip-fits within the smooth bore 292 of the plug assembly 214. Just as the lower holes 270 open through the lower end region of the surface 330, the upper holes 320 open through the upper end region of the surface 330.

The upper part 310 has a threaded surface portion 332 which is threaded into the threaded bore 294, and a larger diameter threaded surface portion 334 which extends loosely through and projects upwardly from the smooth bore 296. An O-ring 340 is carried near the junctures of the threaded portions 332, 334. The O-ring 340 engages the walls of the bore 296 for establishing a liquid-tight seal between the upper part 310 and the plug assembly 214 to prevent the escape of liquid and/or gas from the open upper end of the bore 290. A lock nut 342 is threaded onto the upper end region of the threaded surface portion 334 for engaging the top wall 215 of the plug assembly 214 to lock the suction tube assembly 216 from rotating relative to the plug assembly 214.

A hex-head formation 350 is provided atop the upper part 310 for positioning the suction tube assembly 216 relative to the plug assembly 214. By rotating the suction tube assembly 216 in one direction relative to the plug assembly 214, the threaded engagement between the threaded stem portion 332 and the threaded bore 294 causes the suction tube assembly 216 to move downwardly with respect to the central passage 290, thereby exposing more of each of the holes 270 beneath the bottom surface 233 to thereby increase the "effective sizes" of the holes 270. By rotating the suction tube assembly 216 in the opposite direction, the "effective sizes" of the holes 270 are likewise diminished. By tightening the lock nut 243 against the top surface 215, a desired setting of the "effective sizes" of the holes 270 can be maintained.

Figure 11:
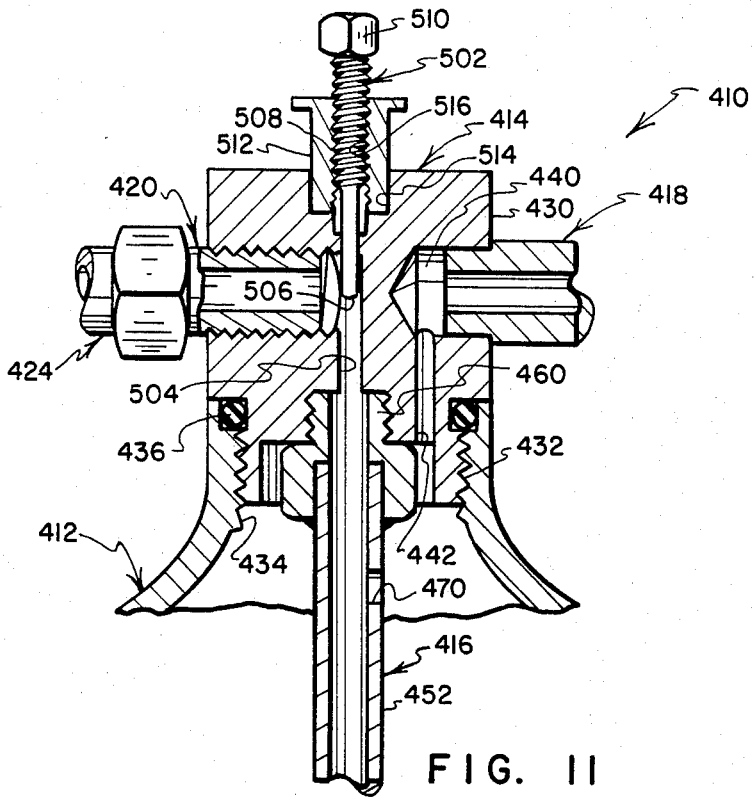
FIGS. 11 and 12 are sectional views similar to FIG. 3 showing modified forms of the apparatus of FIG. 1; and, FIGS. 13, 14 and 15 are sectional views similar to FIGS. 3, 7 and 9, respectively, showing modified forms of the spraying apparatus embodiments of FIGS. 3, 7 and 9.

Referring to FIG. 11, one modified form of the apparatus 10 is indicated generally by the numeral 410. The majority of the elements of the apparatus 410 are identical in form and function with those of the apparatus 10. Elements of the apparatus 410 which are the functional equivalent of described elements of the apparatus 10 are indicated by numerals which differ by a magnitude of "400" from the elements of the apparatus 10. Elements of the apparatus 410 which are not found in the apparatus 10 are designated by numerals in the "500" series.

A feature of the apparatus 410 resides in its provision of a supplemental means for controlling the flow discharge rate at which materials are sprayed. The supplemental flow control takes the form of a valve stem member 502 which may be raised or lowered to control the flow of fluid through a small diameter passage 504. The passage 504 communicates the suction tube assembly 416 with the outlet conduit 420. The rate at which fluid flows through the passage 504 is controlled by the degree to which the lower end 506 of the valve stem 502 restricts the flow of fluid moving through the passage 504.

The valve stem 502 has a central portion 508 which is threaded, and an upper end portion which has a driving formation 510 provided thereon. A sleeve 512 is press-fitted into a hole 514 formed in the plug assembly 414. Threads 516 are provided within the sleeve 510 to receive the threaded central portion 508 of the valve stem 502. By rotating the valve stem 502 in one direction relative to the plug assembly 414, the stem end 506 is moved downwardly to form a more effective obstruction to fluid flowing through the passage 504. By rotating the valve stem 502 in the opposite direction, the degree to which the stem end 506 obstructs the discharge of fluid from the passage 504 is lessened, whereby the flow rate of fluid through the passage 504 is increased.

Figure 12:
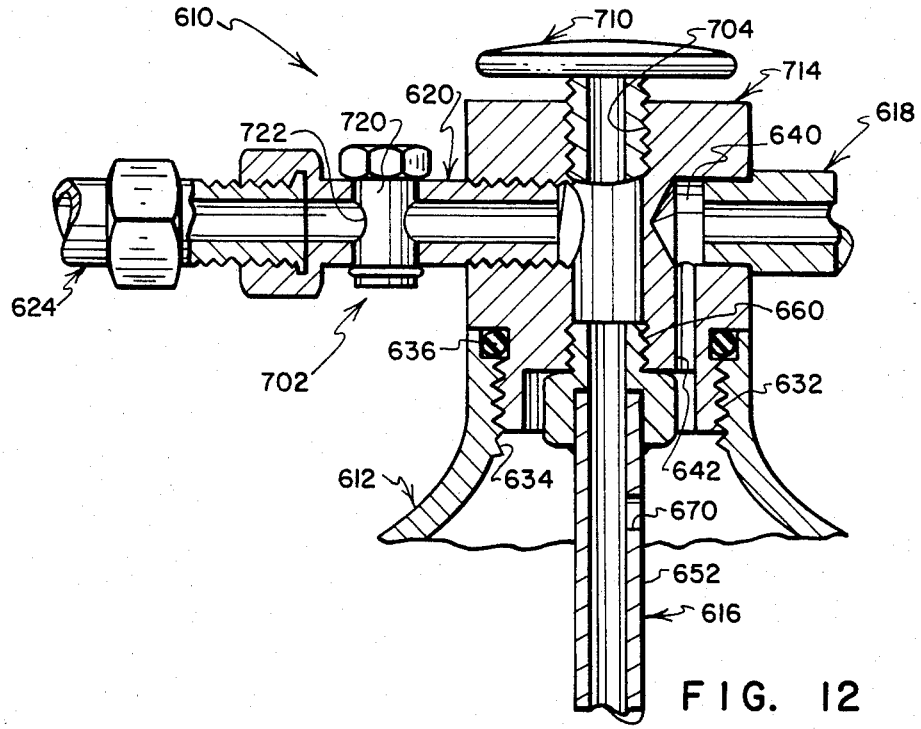

Referring to FIG. 12, another modified form of the apparatus 10 is indicated generally by the numeral 610. In the apparatus 610, supplemental discharge rate control is provided by incorporating a conventional valve 702 in a discharge conduit 620. A further feature of the apparatus 610 resides in the provision of a threaded passage 704 in the plug assembly 614 for mounting a conventional pressure gauge 710 for monitoring discharge flow pressure.

The apparatus 610 has elements which are identical in form and function with elements of the apparatus 10, except for the provision of the valve 702 in the discharge conduit 620, and for the provision of the pressure gauge 710 in the bore 704. Identical elements in the apparati 10, 610 are indicated by elements which differ by a magnitude of "600". Elements in the apparatus 610 which are not present in the apparatus 10 are indicated by numerals of the "700" series.

The valve 702 includes a rotatable gate member 720 which has a hole 722 formed therethrough at a location wherein the hole 722 may be positioned to fully align, or to only partially align with the discharge passage 620, whereby the rotary position of the gate member 720 will serve to supplementally regulate the flow of fluid discharging through the passage 620.

The supplemental discharge rate controls provided with the apparati 410, 610 are exemplary of the types of auxiliary controls which can be utilized with any of the apparati 10, 110, 210 to enhance the precision with which the rate at which materials being discharged can be regulated.

As will be apparent from the foregoing description, a feature of the present invention lies in a novel method of regulating the discharge rate at which liquid is sprayed from a spraying apparatus. The novel method centers about the controlling of the actual or effective size of one or more gas entry openings, such as the openings 70, 170, 270, 470, 670. By controlling the sizes of these gas entry openings, the relative quantities of liquid and gas which are delivered in the ultimate flow reaching a discharge nozzle are likewise regulated, i.e., a means is provided for controlling the discharge rate of the liquid being sprayed by proportioning the relative quantities of carrier gas and liquid which comprise the mixture of fluid that is withdrawn from pressurized vessels.

Figure 13:
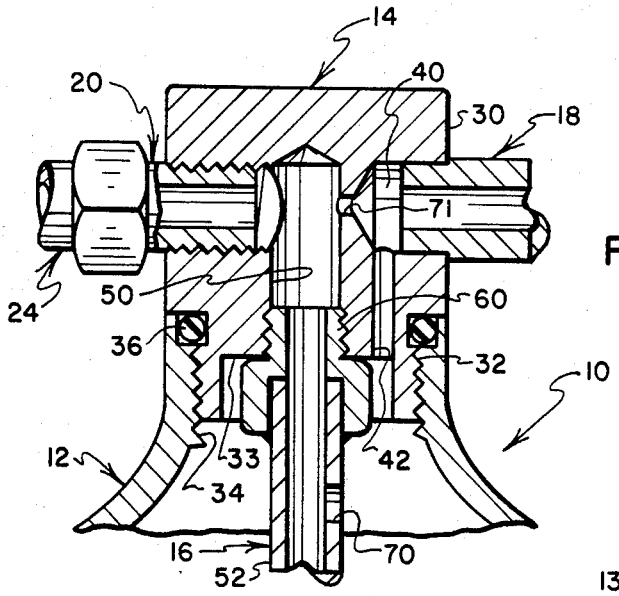
Figure 14:
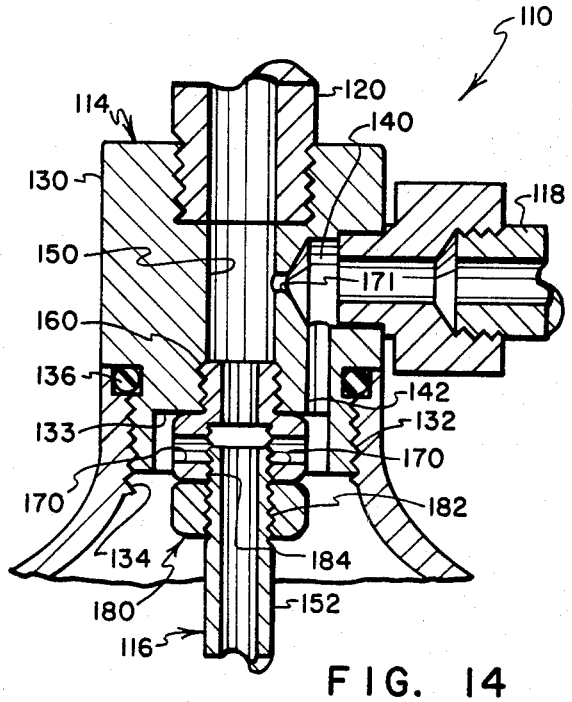
Figure 15:
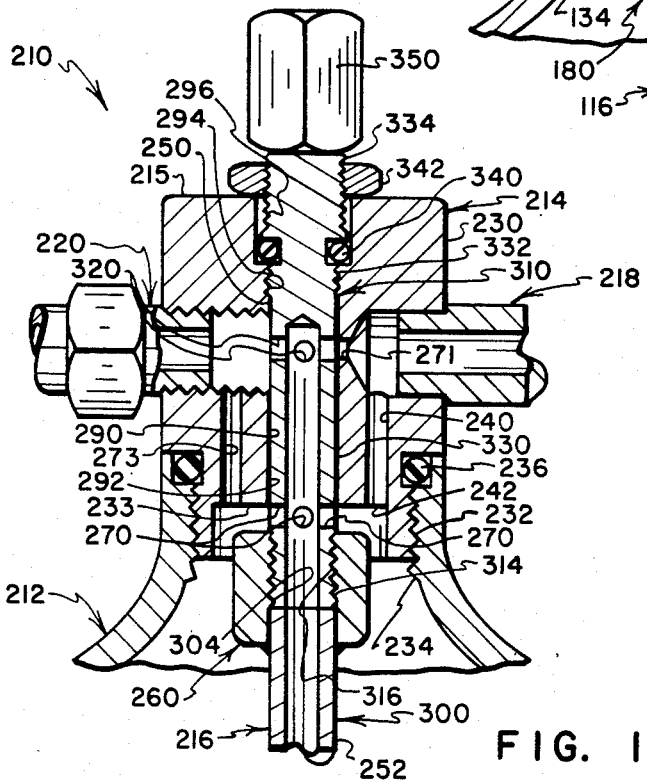

Referring to FIGS. 13, 14 and 15, the embodiments 10, 110, 210 of FIGS. 3, 7 and 9 (as well as the other described embodiments) can be modified quite easily to provide passages 71, 171, 271, respectively, which will admit a restricted flow of carrier gas substantially directly from the inlet conduits 18, 118, 218 to the outlet conduits 20, 120, 220, respectively, for the purpose of causing a turbulent mixing with the mixture of gas and liquid being withdrawn from the respective pressure vessels 12, 112, 212. This turbulent mixing causes a high degree of atomization of such liquid as is being withdrawn from the pressure vessels, whereby what discharges from the apparati is a highly atomized, fog-like spray.

Referring to FIG. 15, the apparatus 210 is shown provided with an optional passage 273 which can also be incorporated, where desired, in the other described embodiments. The passage 273 opens through the bottom wall 233 and communicates with the outlet conduit 220. The passage 273 acts as a vent for relieving pressure in the vessel 212 to minimize "after spray" when the flow control valve associated with the apparatus 210 is turned off.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A spraying apparatus, comprising:

(a) a vessel defining a pressurizable chamber having a lower region for receiving a quantity of liquid to be sprayed, and an upper region for receiving pressurized carrier gas for pressurizing the contents of the chamber;

(b) inlet means for communicating the upper region with a source of pressurized carrier gas;

(c) nozzle means for receiving a mixture of pressurized carrier gas and liquid from the vessel for discharge as a spray, (d) outlet means for ducting a pressurized mixture of liquid from the lower region and carrier gas from the upper region along a common path of flow for discharge through the nozzle means as a spray, the outlet means including:

(i) elongate tubular means defining a tubular passage extending from the lower region into the upper region, the tubular means having at least one liquid entry opening communicating the tubular passage with the lower region for admitting liquid under pressure from the lower region into the tubular passage, and having at least one gas entry opening communicating the tubular passage with the upper region for admitting carrier gas under pressure from the upper region into the tubular passage;

(ii) passage-defining means cooperating with the tubular means for defining a common path of flow for liquid admitted to the tubular passage through the liquid entry opening, and for gas admitted to the tubular passage through the gas entry opening, the common flow path extending from the location of the gas entry opening to the nozzle means; and, (e) adjustment means for controlling the effective size of the gas entry opening to selectively vary the rate at which liquid is ducted along the common flow path, the adjustment means including first and second means which are threadably interconnected and which are relatively movable, with the gas entry opening being defined between portions of the relatively movable first and second means to enable the effective size of the gas entry opening to be controlled by threading the first and second means to move the portions toward and away from each other for controllably obstructing the flow of pressurized carrier gas through the gas entry opening.

2. The apparatus of claim 1 wherein the portions are movable relative to each other between a fully open position wherein substantially no obstruction is provided to the flow of gas through the gas entry opening, and a fully closed position wherein the flow of gas through the gas entry opening is substantially foreclosed.

3. The apparatus of claim 1 wherein the adjustment means includes retaining means for securing the first and second means in a selected position relative to each other.

4. The apparatus of claim 1 wherein the adjustment means includes an operating formation located externally of the chamber of the vessel for controlling the relative position of the portions to enable the rate of liquid along the flow path to be adjusted during spraying.

5. The apparatus of claim 1 additionally including supplemental discharge rate control means located along the common flow path at a position between the gas entry opening and the nozzle means, the supplemental control means including valve means for selectively restricting the flow of liquid and gas along the common flow path.

6. The apparatus of claim 1 additionally including pressure-indicating means in communication with the common flow path for indicating the pressure of the liquid and gas as it flows along the common flow path.

7. The apparatus of claim 1 wherein:

(a) the gas entry opening includes a plurality of gas entry openings each of which communicates the tubular passage with the upper region for admitting gas from the upper region into the tubular passage; and, (b) the adjustment means is operable to control the effective sizes of at least two of the plurality of gas entry openings.

8. The apparatus of claim 7 additionally including adjustment means for concurrently controlling the effective sizes of each of the gas entry openings to selectively vary the rate at which liquid is ducted along the common flow path, the adjustment means including structure which is movable relative to the gas entry openings for obstructing the flow of gas through the gas entry openings.

9. The apparatus of claim 8 wherein the structure is movable relative to the gas entry openings between a fully open position wherein the structure forms substantially no obstruction to the flow of gas through the gas entry openings, and a fully closed position wherein the structure substantially forecloses the flow of gas through the gas entry openings.

10. The apparatus of claim 8 wherein the adjustment means includes retaining means for securing the structure in a selected position relative to the gas entry openings.

11. The apparatus of claim 8 wherein the adjustment means includes an operating formation located externally of the chamber of the vessel for controlling the position of the structure relative to the gas entry openings to enable the rate of flow of liquid along the flow path to be adjusted during spraying.

12. The apparatus of claim 1 additionally including passage means for ducting a restricted flow of carrier gas from the inlet means to the outlet means for combining with the mixture of liquid and carrier gas being withdrawn from the vessel to effect a turbulent atomization of the liquid, whereby the spray which issues from the nozzle means is in the form of a highly atomized fog.

13. A spraying apparatus for spraying a quantity of liquid at a controlled rate of discharge, comprising:

(a) an upwardly opening pressure vessel defining an upwardly opening pressurizable chamber therein;

(b) closure means removably secured to the vessel for closing the upwardly opening chamber;

(c) inlet means for communicating an upper region of the chamber with a source of pressurized carrier gas, the inlet means including an inlet passage formed through the closure means;

(d) nozzle means for receiving a mixture of pressurized gas and liquid from the vessel;

(e) outlet means for concurrently ducting liquid from a lower region of the chamber and pressurized gas from an upper region of the chamber along a common path of flow for discharge through the nozzle means as a spray, the outlet means including:

(i) an outlet passage formed through the closure means;

(ii) a tubular structure carried by the closure means and depending therefrom through the upper region of the chamber into the lower region of the chamber, and defining a tubular passage which extends from the lower region through the upper region and into communication with the outlet passage;

(iii) at least one liquid entry opening formed in the tubular structure communicating the lower region with the tubular passage for admitting liquid from the lower region into the tubular passage;

(iv) at least one gas entry opening formed in the tubular structure communicating the upper region with the tubular passage for admitting pressurized gas from the upper region into the tubular passage;

(v) the outlet passage and the tubular passage cooperating to define a common path of flow for liquid and gas admitted to the tubular passage from the upper and lower regions, the common flow path extending from the location of the gas entry opening to the nozzle means; and, (f) adjustment means for controlling the effective size of the gas entry opening to selectively proportion such quantities of carrier gas and liquid as are ducted along the common flow path, the adjustment means including first and second means which are threadably interconnected and which are relatively movable, with the gas entry opening being defined between portions of the relatively movable first and second means to enable the effective size of the gas entry opening to e controlled by threading the first and second means to move the portions toward and away from each other for controllably obstructing the flow of gas through the gas entry opening.

14. The apparatus of claim 13 wherein:

(a) the closure means has an upwardly extending bore formed therein which defines at least a portion of the outlet passage;

(b) the upwardly extending bore opens through a bottom surface of the closure means; and, (c) the gas entry opening is located in close proximity to said bottom surface.

15. The apparatus of claim 14 wherein the gas entry opening includes a plurality of gas entry openings formed through the tubular structure, each of which is located in close proximity to said bottom surface.

16. The apparatus of claim 15 wherein the adjustment means includes means for adjustably controlling the effective size of at least two of the plurality of gas entry openings by blocking off portions thereof to selectively obstruct the flow of carrier gas therethrough.

17. The apparatus of claim 14 wherein the inlet passage is formed, at least in part, by another upwardly extending bore which is formed in the closure means and which opens through said bottom surface.

18. The apparatus of claim 14 additionally including passage means for ducting a restricted flow of carrier gas from the inlet means to the outlet means for combining with the mixture of liquid and carrier gas being withdrawn from the vessel to effect a turbulent atomization of the liquid, whereby the spray which issues from the nozzle means is in the form of a highly atomized fog.

19. The apparatus of claim 14 wherein a selected one of the first and second means includes a sleeve-like member carried by and encircling the other of said first and second means.

20. The apparatus of claim 14 wherein the tubular structure is connected to the closure means by a threaded connector.

21. A spraying apparatus for spraying a quantity of liquid at a controlled rate of discharge, comprising:

(a) an upwardly opening pressure vessel defining an upwardly opening pressurizable chamber therein;

(b) closure means removably secured to the vessel for closing the upwardly opening chamber;

(c) inlet means for communicating an upper region of the chamber with a source of pressurized carrier gas, the inlet means including an inlet passage formed through the closure means;

(d) nozzle means for receiving a mixture of pressurized gas and liquid from the vessel;

(e) outlet means for concurrently ducting liquid from a lower region of the chamber and pressurized gas from an upper region of the chamber along a common path of flow for discharge through the nozzle means as a spray, the outlet means including:

(i) an outlet passage formed through the closure means;

(ii) a tubular structure carried by the closure means and depending therefrom through the upper region of the chamber into the lower region of the chamber, and defining a tubular passage which extends from the lower region through the upper region and into communication with the outlet passage;

(iii) at least one liquid entry opening formed in the tubular structure communicating the lower region with the tubular passage for admitting liquid from the lower region into the tubular passage;

(iv) at least one gas entry opening formed in the tubular structure communicating the upper region with the tubular passage for admitting pressurized gas from the upper region into the tubular passage;

(v) the outlet passage and the tubular passage cooperating to define a common path of flow for liquid and gas admitted to the tubular passage from the upper and lower regions, the common flow path extending from the location of the gas entry opening to the nozzle means;

(f) adjustment means for controlling the effective size of the gas entry opening to selectively proportion such quantities of carrier gas and liquid ducted along the common flow path, the adjustment means including structure which is movable relative to the location of the gas entry opening for controllably obstructing the flow of gas through the gas entry opening;

(g) the closure means having an upwardly extending bore formed therein which defines at least a portion of the outlet passage;

(h) the upwardly extending bore opening through a bottom surface of the closure means;

(i) the gas entry opening being located in close proximity to said bottom surface; and, (j) the adjustment means including means for adjustably positioning the tubular structure with respect to said bottom surface such that said bottom surface is used to selectively obstruct the gas entry opening.

22. The apparatus of claim 21 wherein the means for adjustably positioning the tubular structure includes an elongate threaded member which is threaded into the upwardly extending bore and which is rotatable with respect to the closure means to vertically position the tubular structure with respect to the closure means.

23. A spraying apparatus for spraying a quantity of liquid at a controlled rate of discharge, comprising:

(a) an upwardly opening pressure vessel defining an upwardly opening pressurizable chamber therein;

(b) closure means removably secured to the vessel for closing the upwardly opening chamber;

(c) inlet means for communicating an upper region of the chamber with a source of pressurized carrier gas, the inlet means including an inlet passage formed through the closure means;

(d) nozzle means for receiving a mixture of pressurized gas and liquid from the vessel;

(e) outlet means for concurrently ducting liquid from a lower region of the chamber and pressurized gas from an upper region of the chamber along a common path of flow for discharge through the nozzle means as a spray, the outlet means including:

(i) an outlet passage formed through the closure means;

(ii) a tubular structure carried by the closure means and depending therefrom through the upper region of the chamber into the lower region of the chamber, and defining a tubular passage which extends from the lower region through the upper region and into communication with the outlet passage;

(iii) at least one liquid entry opening formed in the tubular structure communicating the lower region with the tubular passage for admitting liquid from the lower region into the tubular passage;

(iv) at least one gas entry opening formed in the tubular structure communicating the upper region with the tubular passage for admitting pressurized gas from the upper region into the tubular passage;

(v) the outlet passage and the tubular passage cooperating to define a common path of flow for liquid and gas admitted to the tubular passage from the upper and lower regions, the common flow path extending from the location of the gas entry opening to the nozzle means;

(f) adjustment means for controlling the effective size of the gas entry opening to selectively proportion such quantities of carrier gas and liquid ducted along the common flow path, the adjustment means including structure which is movable relative to the location of the gas entry opening for controllably obstructing the flow of gas through the gas entry opening;

(g) the closure means having an upwardly extending bore formed therein which defines at least a portion of the outlet passage;

(h) the upwardly extending bore opening through a bottom surface of the closure means;

(i) the gas entry opening being located in close proximity to said bottom surface; and, (j) the tubular structure being connected to the closure means by a threaded connector; and, (k) the threaded connector includes relatively movable parts which form at least a portion of the adjustment means inasmuch as the relatively movable parts can be positioned to selectively obstruct the gas entry opening to restrict its effective size and to thereby control the rate of flow of gas through the gas entry opening.

24. A method of spraying a quantity of liquid at a controlled rate of discharge from a spraying apparatus, comprising the steps of:

(a) providing a spraying apparatus of the type including a pressure vessel for receiving liquid to be sprayed, inlet means for communicating the vessel with a source of pressurized carrier gas to supply pressurized gas to an upper region of the vessel at a location above the level of liquid contained in the vessel, and outlet means for ducting a proportioned mixture of liquid and carrier gas from the vessel to a spray nozzle for discharge, the outlet means including tubular means depending through the upper region of the vessel and into such liquid as may be contained within the vessel, the tubular means having a liquid entry opening near its lower end and defining a travel path for liquid to follow in moving from the vessel to the outlet means for withdrawing liquid from the vessel;

(b) providing at least one gas entry opening in the suction tube means to define a carrier gas entry passage communicating the upper region with the travel path for admitting pressurized carrier gas from the upper region to the travel path;

(c) providing the spraying apparatus with means in the form of a pair of threadably engaged, relatively movable structures that may be threadably moved relative to each other to effect relative movement thereof for bringing spaced portions toward and away from each other for adjusting the effective size of the gas entry opening by selectively adjusting the degree of which the opening is obstructed, and for providing a desired proportion of carrier gas and liquid in the mixture which is delivered through the outlet means to the nozzle to thereby control the rate of discharge of liquid being sprayed;

(d) introducing a quantity of liquid to be sprayed into the vessel;

(e) operating the spraying apparatus by supplying pressurized gas through the inlet means to the upper region of the vessel to effect movement of liquid to be sprayed along the travel path for discharge from the spraying apparatus at a discharge rate determined by the effective size of the gas entry passage.

25. The method of claim 24 additionally including the steps of:

(a) providing a separate passage for admitting a restricted flow of pressurized gas from the inlet means to the outlet means to combine with the mixture of gas and liquid being delivered to the nozzle from the vessel; and, (b) permitting the passage of a restricted flow of carrier gas through the separate passage for causing a turbulent atomization of the liquid in the mixture being delivered from the vessel to the nozzle, whereby the spray which issues from the nozzle is in the form of a highly atomized fog.

* * * * *